US012389933B2

(12) United States Patent
Dottor et al.

(10) Patent No.: US 12,389,933 B2
(45) Date of Patent: Aug. 19, 2025

(54) CASTING APPARATUS FOR THE PRODUCTION OF A CAST WEB OF A MATERIAL CONTAINING ALKALOIDS

(71) Applicant: PHILIP MORRIS PRODUCTS S.A., Neuchatel (CH)

(72) Inventors: Marco Dottor, Bologna (IT); Ayoub Lhaou, Nonantola (IT); Marc A.F. Van Den Boogaart, Giez (CH)

(73) Assignee: Philip Morris Products S.A., Neuchatel (CH)

( * ) Notice: Subject to any disclaimer, the term of this patent is extended or adjusted under 35 U.S.C. 154(b) by 821 days.

(21) Appl. No.: 17/251,396

(22) PCT Filed: Jun. 28, 2019

(86) PCT No.: PCT/EP2019/067437
§ 371 (c)(1),
(2) Date: Dec. 11, 2020

(87) PCT Pub. No.: WO2020/002655
PCT Pub. Date: Jan. 20, 2020

(65) Prior Publication Data

US 2021/0244072 A1 Aug. 12, 2021

(30) Foreign Application Priority Data

Jun. 29, 2018 (EP) ..... 18181010

(51) Int. Cl.
*A24B 3/14* (2006.01)

(52) U.S. Cl.
CPC ..... *A24B 3/14* (2013.01)

(58) Field of Classification Search
CPC ..... A24B 3/14; A24B 15/14; A24B 15/12; A24B 15/167; A24B 3/08; A24B 7/00
See application file for complete search history.

(56) References Cited

U.S. PATENT DOCUMENTS 1,818,267 A * 8/1931 Niks ..... D21F 1/028 162/347
2,034,402 A * 3/1936 Leloff ..... D21F 1/028 162/347

(Continued)

FOREIGN PATENT DOCUMENTS

EP 0565360 10/1993
WO WO 2016/050471 4/2016

OTHER PUBLICATIONS

"Nicotine." American Chemical Society, Aug. 20, 2018, www.acs.org/molecule-of-the-week/archive/n/nicotine.html. Accessed Aug. 22, 2023. (Year: 2018).*

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

A casting apparatus for the production of a cast web of a material containing alkaloids includes (a) a casting box having casting box walls including a first and a second opposite walls, and adapted to contain a slurry; (b) a movable support; (c) a casting blade adapted to cast the slurry contained in the casting box onto the movable support so as to form the cast web of said material containing alkaloids; and (d) a bar-like element located inside the casting box in contact with the slurry, the bar-like element being positioned at a first and at a second distance from the first and the second opposite walls, respectively, so that the slurry can flow around the bar-like element.

12 Claims, 3 Drawing Sheets

(56) References Cited

U.S. PATENT DOCUMENTS

| | | | | |
|---|---|---|---|---|
| 3,098,492 | A | 7/1963 | Wurzburg | |
| 3,799,832 | A * | 3/1974 | Reick | B32B 27/322 156/330 |
| 4,325,391 | A | 4/1982 | Schmidt | |
| 5,100,513 | A * | 3/1992 | Crawford | D21F 1/02 162/344 |
| 2002/0129826 | A1* | 9/2002 | Nakanishi | A24B 15/14 131/370 |
| 2004/0255965 | A1* | 12/2004 | Perfetti | A24B 15/308 131/352 |
| 2008/0245378 | A1* | 10/2008 | Liu | A24B 3/14 131/374 |
| 2016/0106143 | A1* | 4/2016 | Mei | A24B 15/14 131/374 |
| 2017/0340001 | A1* | 11/2017 | Soo | A24B 15/12 |

OTHER PUBLICATIONS

"Propeller Anatomy." Accutech, accutechmarine.com/propeller-anatomy/#:~:text=Blades%3A%20the%20propeller%20blades%20are,pressure%20face%2C%20of%20the%20blade. Accessed Aug. 22, 2023. (Year: 2018).*

Search Report and Written Opinion for PCT/EP2019/067437 mailed Sep. 19, 2019 (11 pages).

* cited by examiner

COMPARATIVE EXAMPLE

COMPARATIVE EXAMPLE

CASTING APPARATUS FOR THE PRODUCTION OF A CAST WEB OF A MATERIAL CONTAINING ALKALOIDS

This application is a U.S. National Stage Application of International Application No. PCT/EP2019/067437 filed Jun. 28, 2019, which was published in English on Jan. 2, 2020 as International Publication No. WO 2020/002655 A1. International Application No. PCT/EP2019/067437 claims priority to European Application No. 18181010.2 filed Jun. 29, 2018.

This invention relates to a casting apparatus for producing a cast web of a material containing alkaloids.

In particular, the material containing alkaloids is a homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder, are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatuses may result in unintended variations in the application of the slurry onto a support during the casting of webs of homogenized tobacco. A non-optimal casting method and apparatus may lead to inhomogeneity and defects in the cast web of homogenized tobacco.

Inhomogeneity in the homogenized tobacco web may lead to difficulties in subsequent handling of the homogenized tobacco web for the production of the aerosol-generating article. For example, inhomogeneity may lead to tearing of the web or even rupture of the web during manufacturing or further processing of the web. This in turn could, for example, result in machine stops. Additionally, an inhomogeneous tobacco web may create unintended difference in the aerosol delivery between aerosol generating articles that are produced from the same homogenized tobacco web.

There is a need for a casting apparatus for the production of a cast web of a material containing alkaloids that is adapted to overcome, or at least considerably decrease, the above-mentioned issues.

The invention relates to a casting apparatus for the production of a cast web of a material containing alkaloids, the casting apparatus comprising: a casting box having casting box walls including a first and a second opposite walls, and adapted to contain a slurry; a movable support; a casting blade adapted to cast the slurry contained in the casting box onto the movable support so as to form the cast web of said material containing alkaloids; and a bar-like element located inside the casting box in contact with the slurry, the bar-like element being positioned at a first and at a second distance from the first and the second opposite walls, respectively, so that the slurry can flow around the bar-like element.

Advantageously, the bar-like element located inside the casting box and positioned at a first and at a second distance from the first and the second opposite walls, allows to reduce the formation of agglomerations in the slurry and thus in turn to minimize the number of defects in the cast web. Such agglomerations of slurry may form in the casting box because of the poor recirculation of the slurry inside the casting box. The bar-like element may improve the slurry's circulation and recirculation within the casting box.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, the edge may have a rectangular or a rounded shape.

As used herein, the term "movable support" denotes any means comprising a surface that can be moved in at least one direction. The movable support may form a closed loop so as to provide an uninterrupted transporting ability in one direction. However, the movable support may be moved in a back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product. A cellulose pulp containing cellulose fibers is preferably added to the slurry in order to increase the tensile strength of the alkaloids material web, acting as a strengthening agent. A binder may be added. An aerosol-former may be added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry. The slurry may be mixed in order to render it as homogeneous as possible.

The slurry may be then collected in a casting box, in which a pre-defined amount of slurry is preferably maintained, for example a pre-determined level of slurry within the casting box is set. Preferably, slurry is continuously supplied to the casting box while the slurry is cast onto a movable support by means of a casting blade to form a continuous web of material containing alkaloids. The movable support moves along a direction which defines the direction of extension of the cast sheet and it is also called casting direction.

The casting-box is preferably box-shaped and includes at least a first and a second wall, and preferably also a third and fourth wall. Walls from first to fourth can be considered as sidewalls of the casting box. The box can be open on the upper side or might include a lid or a top wall. In addition, the casting box may include a bottom wall having an aperture, or might be open at the bottom. First and second walls are preferably one facing the other. Preferably, also third and fourth wall are one facing the other.

The casting blade is preferably arranged perpendicular to the casting direction. The web of material is formed by means of the casting blade that casts the slurry present in the casting box. The slurry, for example, falls by gravity from the casting box and comes into contact with the casting blade. The edge of the casting blade forms indeed a gap with a top surface of the movable support and the slurry passes through the aperture defined by said gap. The thickness of the cast web of material may be determined by the gaps dimensions, for example by the distance between the edge of the casting blade that comes into contact with the slurry and the surface of the movable support.

According to the invention, the casting box comprises a bar-like element located inside it. The bar-like element may be considered as a solid element, which is not in contact with two opposite walls of the casting box, in this case the first and second walls. With opposite first and second walls, two walls (or portion thereof) of the casting box which face at least partially each other are meant. The bar-like element is preferably located in a volume of the casting box where the slurry rotational speed is very low or null. The bar-like element does not touch the first and second wall, that is, there is a distance between the first and second walls and the bar-like element, distance which is different from zero, so that the slurry can flow around the bar-like element. The slurry flow is around the bar-like element, for example between an outer surface of the bar-like element and the side walls.

The purpose of this transversal bar-like element may be to suppress or limit accessibility for the slurry to zones, areas or volumes of the casting box where the speed or the flow of the slurry would be otherwise, that is without the bar-like element, very low or almost null. Further, it may be used to limit or deny access to zones, areas or volumes of the casting box where slurry circulation or recirculation would tend to converge to a very low speed, and where the slurry could agglomerate.

During manufacturing, the slurry in the casting box may agglomerate, creating "solids", "lumps" or "clusters". Such agglomerations of slurry may be an issue in the casting of the web. The smaller agglomerations, that is, slurry clusters, the dimensions of which are below the dimension of the gap between casting blade and movable support, may create clusters in the web. Clusters in the web form a non-homogeneous web, which may lead to a non-consistent smoking experience.

The larger agglomerations, that is, slurry clusters the dimensions of which are above the gap's dimension, cannot pass under the casting blade and so could create "Slits and Draggers", for example obstructions, which may tear the web.

Without being bound by theory, the circulation of the slurry inside the casting box is driven by the fall of the incoming slurry from the input device and by the movement of the moving belt going toward the casting blade at the front exit of the casting box. Due to the high viscosity of the slurry and its global low speed, the overall movement of the slurry could be depicted as the movements of laminar layers turning around a somewhat central core axis, with the rotational speeds of the layers decreasing down to zero as they get closer to this indicated core axis, like a multilayers solid turning around an axis. Such behavior of the slurry inside the casting box generates a specific volume at the central core of the casting box where the slurry parts collide and enter in contact with each other at very low speed, causing the slurry to agglomerate and to create conglomerates. The position of the bar-like element in this area may limit the formation of conglomerates because it "forbids" access to the low or zero speed region.

The casting apparatus according to the invention can include one or more of the following preferred features, considered alone or in combination.

In a preferred embodiment, the bar-like element defines a longitudinal axis and an overall volume of bar-like element is constant along the longitudinal axis thereof. The constant volume allows achieving a transversal homogeneity of the cast web of a material containing alkaloids.

In a preferred embodiment, the bar-like element is rotatable around an axis. Preferably, the axis is the longitudinal axis of the bar-like element. More preferably, the bar-like element is a shaft. This shaft can be freely rotatable or may be motorized in rotation in respect of its longitudinal axis. Advantageously, the slurry circulating and recirculating in the casting box makes the bar-like element rotate; in this way the risk of agglomeration of the slurry on the outer surface of the bar-like element is considerably reduced.

In a preferred embodiment, the movable support is adapted to move along a casting direction. Preferably, the bar-like element is positioned substantially perpendicular to the casting direction. Advantageously, the bar-like element is positioned transversally in respect of the direction of movement of the movable support (casting direction). The location of the bar-like element is preferably within the volume of the casting box where the slurry has limited speed.

In a preferred embodiment, the bar-like element has an outer surface and it includes a plurality of fins protruding from the outer surface. The bar-like element may also include, in alternative or in addition, on its outer surface, grooves, agitators or textures. The fins, grooves, agitators or textures may increase the velocity of the slurry that comes into contact with the outer surface of the bar-like element.

Preferably, fins or agitators on the outer surface of the bar-like element are motorized. More preferably, the agitators' or fins' shape is chosen so that their energy is converted into movements of the slurry or into shear stress. Increasing the movements of the slurry may further prevent low speed volumes within the casting box, while generating shear stress in the slurry may help to suppress possible slurry clusters. Preferably, the bar-like element includes dispersion blade agitators.

In a preferred embodiment, a distance between the bar-like element and the casting blade is substantially constant along a dominant dimension of the bar-like element. The dominant dimension preferably corresponds to the longitudinal dimension along the axis of the bar-like element. A substantially constant thickness of the web of the material containing alkaloids may be achieved in an easier manner.

In a preferred embodiment, an axis of the bar-like element and a dominant dimension of the casting blade are substantially parallel. Preferably the axis of the bar-like element is substantially horizontal, that is, it lies on an horizontal plane. Advantageously, the distance between a central axis of the bar-like element and the casting blade (which is also a transversal element) is somewhat constant so as to achieve a transversal homogeneity of the cast web of material containing alkaloids.

The longitudinal axis of the bar-like element is preferably positioned in a central core volume of the casting box where the rotational speed would be the lowest in case there would not be the bar-like element inside the casting box. In order to keep a somehow constant distance between the longitudinal axis of the bar-like element and the casting blade, the position of the longitudinal axis is determined as an average position of the central core area along the casting box. The exact position of central core area or volume can change according to the slurry properties, including viscosity.

In a preferred embodiment, the casting apparatus includes a vibrator device connected to the bar-like element, adapted to vibrate the bar-like element. The vibration can increase again the speed of the slurry in contact with an outer surface of the bar-like element. Preferably, the outer surface of the bar-like element comprises a substantially cylindrical surface. In addition, the vibration may help to dislodge slurry that otherwise could be stuck onto the outer surface of the bar-like element. Such mechanisms for obtaining vibrations could include for instance rotating eccentric weighting discs, ultrasounds, or others.

In a preferred embodiment, the movable support is adapted to move along a casting direction.

Preferably, a dimension of the bar-like element in a cross section parallel to the casting direction is comprised between about 10 millimeters and about 70 millimeters. More preferably, such a dimension is comprised between about 25 millimeters and about 45 millimeters. Preferably, such a cross section of the bar-like element is a circle and such a dimension is the diameter of said circle. The cross section is taken along a plane parallel to the casting direction. Preferably, the plane is a vertical plane.

In a preferred embodiment, the casting box has a given casting box height, and the bar-like element is positioned in the casting box at a height which is substantially half of the casting box height. The height of the casting box is defined as its highest coordinate value along a vertical axis. The point of reference, or "zero", is considered the lowest coordinate value of the casting box along the same vertical axis. Generally, the height of the casting box corresponds to the height of the side walls, which is commonly the same for all side walls. The "zero" corresponds generally to the bottom wall of the casting box, which is generally horizontal. If there is more than one height, an average of all different heights is considered as the height of the casting box. The height of the bar-like element is considered as the highest coordinate value of its axis, the reference or "zero" being again the lowest coordinate value of the casting box along the same vertical axis. If there is more than one height, an average of all different heights is considered as the height of the bar-like element.

In a preferred embodiment, the slurry is supplied at a rear or upstream side of the casting box (for example at the first wall of the casting box), where "upstream" is referred to the direction of the slurry flow, the casting blade is located at a front or downstream side of the casting box (for example at the second wall of the casting box), and the bar-like element is substantially positioned in the half of casting box closer to the casting blade, that is, closer to the front or downstream side (for example at the second wall of the casting box), where "downstream" is referred to the direction of the slurry flow. Preferably, the bar-like element is horizontally located closer to the second wall than to the first wall of the casting box. In the vertical direction, it is advantageously located in the middle of the casting box height.

In a preferred embodiment, the bar-like element includes a coating. More preferably, said coating is deformable. The coating is preferably an outer coating which covers an inner body of the bar-like element. This inner body may include various mechanisms allowing it to slightly change shape and/or to vibrate, so that these vibrations are mechanically transmitted to the outer coating as to dislodge slurry that otherwise could get stuck to the outer surface of the bar-like element. Such mechanisms could include for instance pulsated compressed air, injected between the inner body and the outer coating.

In a preferred embodiment, the bar-like element is freely rotatable. In other words, it is freely rotatable in respect of its longitudinal axis of rotation.

In an alternative preferred embodiment, the casting apparatus includes a motor to rotate the bar-like element, that is the bar-like element is motorized in rotation. The bar-like element has motorized rotation movements in respect of its longitudinal axis of rotation. In this case, the bar-like element can alternatively rotate in the two directions, such as a back and forth movements, or can rotate continuously in the rotational direction of the slurry (or in the opposite one), at a rotational speed that can be lower, equal or greater than the rotational speed of the slurry would have in the area or volume around the bar-like element outer diameter if the bar-like element would not be present.

Preferably, the bar like-element rotates around an axis of rotation which corresponds to the central longitudinal axis of the bar-like element. Advantageously, the agglomeration of the slurry on the outer surface of the rotating bar-like element is considerably reduced.

Preferably, the bar-like element is cylindrically shaped.

In a preferred embodiment, in particular in the case wherein the bar-like element is freely rotatable, the bar-like element itself is divided in sectors, each sector being independently rotatable. In this case, advantageously, the rotations of the the bar-like element may vary longitudinally, from one sector to the other along its axis of rotation.

In a preferred embodiment, the casting box includes a third and a fourth opposite walls, wherein the bar-like element includes a first and a second end, said first and second end being connected to the third and fourth wall, and further includes a position variator adapted to change the position of a connection of the first or second end to the third or fourth wall.

Advantageously, the position variator allows choosing the position of the bar-like element. In this way, the position which creates the weakest resistance to the slurry movements, depending on the type of slurry in the casting box, is preferably selected. Accordingly, the way in which the bar-like element is connected to the casting box allows the bar-like element to be moved inside the casting box so that the position of the longitudinal axis of the bar-like element can be adjusted.

According to a preferred embodiment, the bar-like element has fixed attachments to the third and fourth wall of the casting box and is a flexible shaft, so as the exact position of the bar-like element in the "dead zone" of the casting box, the "dead zone" being the volume or area with the lowest rotational speed of the slurry, may be automatically adjusted by the slurry movements themselves, since this "dead zone" is the volume where the bar-like element creates the weakest resistance to the slurry movements. The bar-like element is preferably attached to side walls of the casting-box. Preferably, the bar-like element is directly fixed to the side walls of the casting box. More preferably, the bar-like element is directly fixed to the third and fourth side walls of the casting box at his first and second end, respectively. Preferably, the first and second walls are parallel to the casting blade's longest major dimension which is in turn preferably substantially perpendicular to the casting direction. The third and fourth wall are preferably parallel to the casting direction.

According to an alternative preferred embodiment, the bar-like element has freely moving attachments to the third and fourth wall of the casting box—and is a rigid shaft, so as the exact position of the bar-like element in the "dead zone" of the casting box will be automatically adjusted by the slurry movements themselves, since this "dead zone" is the volume of the casting box where the bar-like element creates the weakest resistance to the slurry movements. Preferably the freely moving attachments keep the bar-like element transversal to the third and fourth wall and in the overall center of the casting box.

In an advantageous embodiment, the casting apparatus comprises a controllable pump adapted to regulate an amount of slurry contained in the casting box. The amount of slurry which is flowing out the casting box is controlled—among others—by the gap present between the casting blade and the movable support and by gravity. The amount of slurry in the casting box has a pre-determined level, which is preferably kept substantially constant so that the pressure exerted by the column of slurry remains substantially the same. Thus, substantially the same amount of slurry flows out the casting box per unit time. In order to keep the amount of slurry substantially at the same level, a controllable pump controls the flow of slurry to the casting box. In this way, the flow of slurry can be regulated preferably as a function of the level of the slurry contained in the casting box. In order to control such a level, a level sensor may be present in or in proximity of the casting box. Advantageously, the level sensor is adapted to send a feedback signal dependent on the height of said slurry contained in said casting box to said controllable pump. Preferably, the height of the slurry within the casting box is at a level comprised between about 50 millimeters and about 400 millimeters from the bottom of the casting box, in order to have a proper pressure for the outflow of slurry from the casting box. The level sensor may send a level signal to a control unit which may activate or deactivate the pump or change the flow rate of the slurry from the pump as a function of the level signal.

In a preferred embodiment, a mean distance between said casting blade and said movable support is comprised between about 0.1 millimeters and about 2 millimeters, more preferably, the mean distance between said casting blade and said support is comprised between about 0.2 millimeters and about 1.5 millimeters. The thickness of the cast web of homogenized tobacco material is relevant for the quality and consistency of the finished product. It is desired that the thickness is homogeneous, that is free of any lumps, agglomerates, fibers and coarse particles.

Preferably, the moisture of the cast web of the material containing alkaloids at casting is between about 60 percent and about 80 percent. Preferably, an apparatus for production of a cast web of a material containing alkaloids comprises said the casting apparatus above described and a dryer to dry the cast web. Preferably, the apparatus also comprises a winder to wind said cast web after drying. Preferably, the moisture of said cast web at winding is between about 7 percent and about 15 percent of dry weight of the tobacco material web. Preferably, the moisture of said cast web at winding is between about 8 percent and about 12 percent of dry weight of the cast web.

The invention may also relate to a casting apparatus for the production of a cast web, said casting apparatus comprising: a casting box having casting box walls including a first and a second opposite walls, and adapted to contain a slurry; a movable support; a casting blade adapted to cast the slurry contained in the casting box onto the movable support so as to form the cast web of said material containing alkaloids; and a bar-like element located inside the casting box in contact with the slurry, the bar-like element being positioned at a first and at a second distance from the first and the second opposite walls, respectively, so that the slurry can flow around the bar-like element.

Further advantages of the invention will become apparent from the detailed description thereof with no-limiting reference to the appended drawings wherein:

FIGS. 1 and 2 show an apparatus 90 for the production of a web of a material containing alkaloids in the example a homogenized tobacco material, according to a comparative example.

The cast web is a cast sheet 1.

Figure 1:
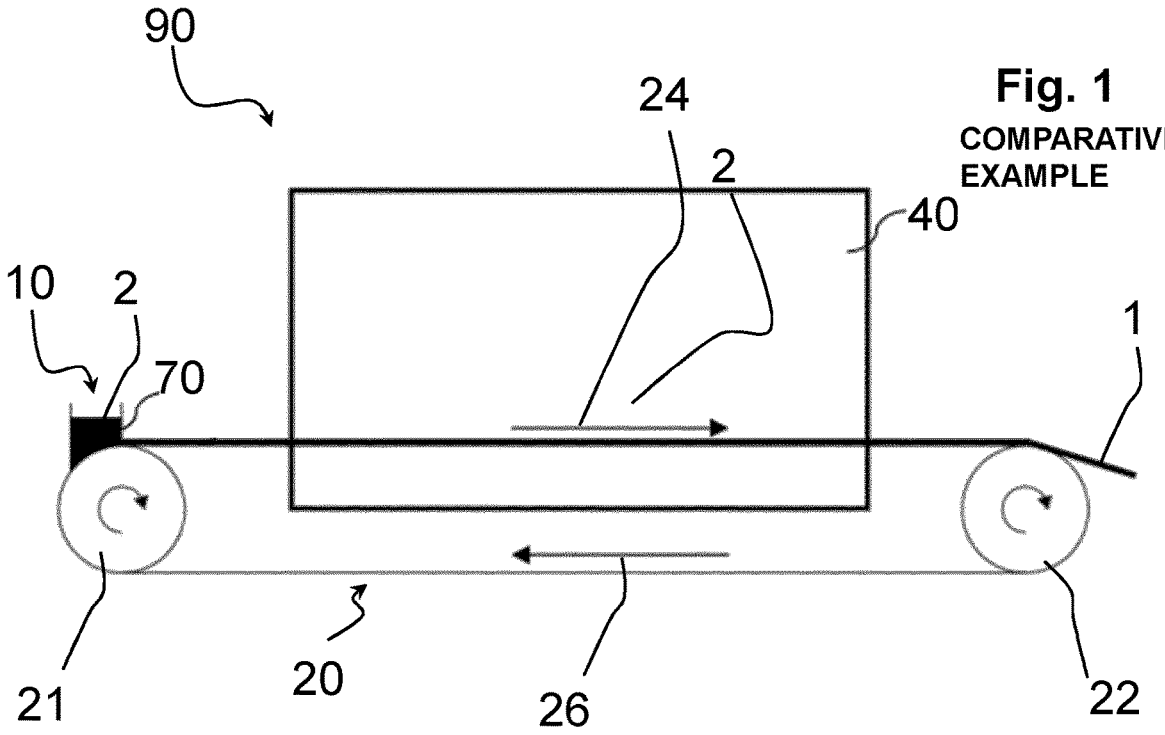
FIG. 1 is a schematic sectional view of an apparatus for the production of a web of a material containing alkaloids including a casting apparatus for the production of a cast web of a material containing alkaloids according to a comparative embodiment.

In FIG. 1, the apparatus 90 comprises a casting box 10 containing slurry 2 and a movable support 20. A casting blade 70—associated to the casting box 10—casts the slurry 2 contained in the casting box 10 onto the movable support 20 so as to form the cast sheet 1 of homogenized tobacco material.

The movable support 20 comprises, in this example, a steel belt wound around a pair of opposite drums 21, 22. The slurry is casted on the steel belt 20—at the drum 21—through the casting blade 70, which creates a continuous sheet 1 of homogenized tobacco material.

The casted slurry forming sheet 1 is transported by the steel belt 20 along a casting direction defined by the arrow 24. The apparatus 90 may further comprise a heating unit 40, where the sheet 1 is progressively heated and homogeneously dried. When the casted sheet 1 is dried, it forms a somewhat solid sheet 1 of homogenized tobacco material, which is separated from the steel belt 20 at the drum 22. The steel belt 20 runs around drum 22 and returns to the casting box 10 as depicted by arrow 26.

During manufacturing, the slurry 2 in the casting box 10 might agglomerate, creating "solids", "lumps" or "clusters".

Figure 2:
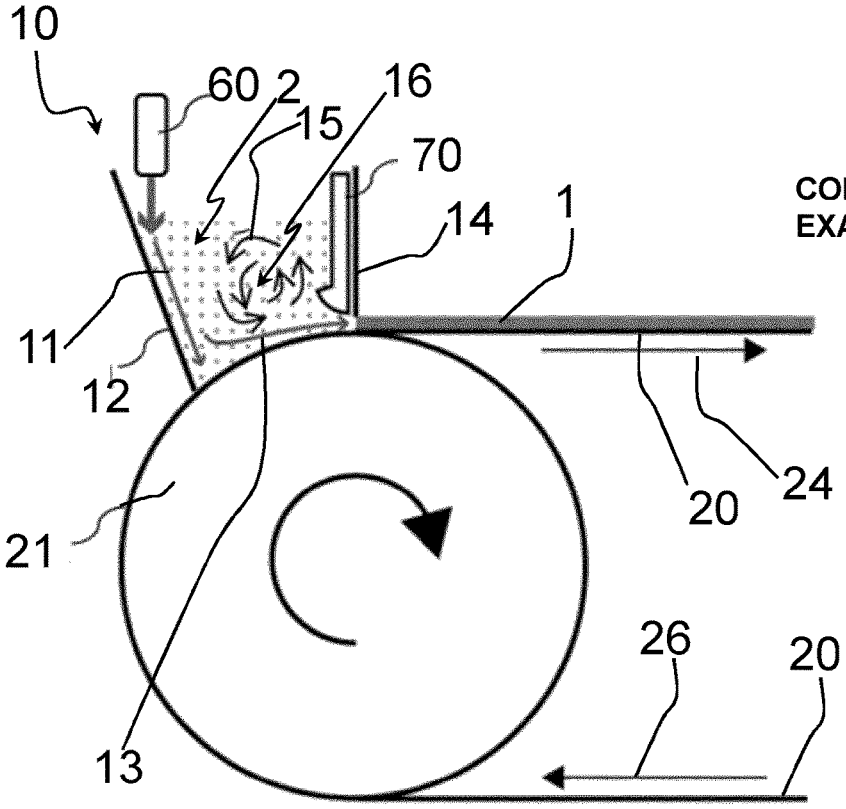
FIG. 2 is an enlarged schematic sectional view of a portion of the apparatus of FIG. 1.

Indeed, with reference to FIG. 2, the Applicant found that the circulation or movements of the slurry 2 inside the casting box 10 is driven by the fall of the incoming slurry 2 from an input device 60 (usually faucet-like devices connected to a mixing tank—not shown—where the slurry 2 is manufactured) at the back of the casting box 10. For example, casting box 10 includes opposite walls 12, 14 and the slurry 2 falls from input device 60 against wall 12 (see arrow 11 at the first wall 12 of the casting box 10). The fall pushes this incoming slurry 2 somehow at the bottom (see arrow 13) of the casting box 10. By the movement of the moving steel belt 20 going toward the casting blade 70 at the front exit of the casting box 10 (at the second wall 14 of the casting box 10, wherein the casting blade 70 is positioned near the second wall 14), the slurry moves in the casting box 10.

For the majority of the slurry 2 which is not casted, there is a circular movement (see arrows 15) returning back toward the input area, that is, there is a recirculation of the slurry 2 inside the casting box 10.

Due to the high viscosity of the slurry 2 and its global low speed, the Applicant found that overall movement of the slurry 2 could be depicted as the movements of laminar layers turning around a somewhat central core axis. This depiction is quite correct even if at each turn a small part of the slurry 2 is cast (that is, only the slurry that passes under the casting blade 70 I cast) and new incoming slurry 2 falls inside the casting box 10.

Such behaviour of the slurry 2 inside the casting box 10 generates a specific volume at the central core of the casting box 10 (in other words, a so-called central "dead zone" 16), where the rotational speed is almost null. In this dead zone, the slurry layers collide and enter in contact with each other at very low speed, leading the slurry 2 to agglomerate and to create bounds.

Figure 3:
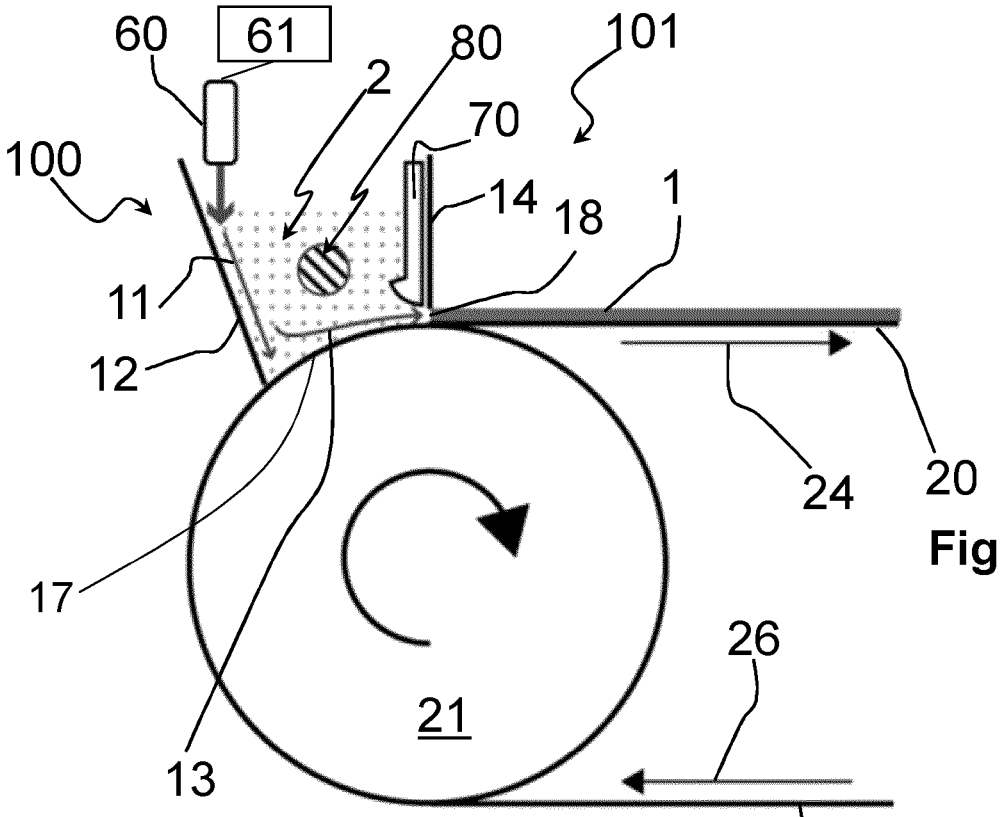
FIG. 3 is a schematic sectional view of a first embodiment of a casting apparatus for the production of a cast web of a material containing alkaloids according to the invention.

With reference to FIG. 3, a first embodiment of a casting apparatus for the production of a cast web of a material containing alkaloids according to the present invention is represented and indicated with reference number 101.

In particular, the casting apparatus 101 is adapted for the production of a cast web of a material containing alkaloids such as a homogenized tobacco material 1.

The casting apparatus 101 comprises a casting box 100 containing slurry 2 and a movable support 20, wherein a casting blade 70 casts the slurry 2 contained in the casting box 100 onto the movable support 20 so as to form the cast sheet 1 of homogenized tobacco material.

The casting box 100 comprises four side walls, first and second opposite walls 12, 14 and a third and a fourth opposite walls (not shown in FIG. 3), which connect the first and second opposite walls 12, 14. The casting blade 70 is associated to the casting box 100 at the second wall 14.

The movable support 20 comprises for example a continuous stainless steel belt including a drum assembly. The drum assembly includes a main drum 21 located below the casting box 100 which moves the movable support 20. Preferably, the casting box 100 is mounted on top of the main drum 21.

The stainless steel belt is wound around a pair of opposite drums (in FIG. 3 the main drum 21 is shown) and moves along a casting direction 24. The slurry is casted on the steel belt 20—at the drum 21—through the casting blade 70, which creates a continuous sheet 1 of homogenized tobacco material. The casting box 100 has an opening 17 in correspondence of its bottom and the opening 17 extends along a width of the casting box 100. The opening 17 is positioned over and in proximity of the drum 21.

The incoming slurry 2 is introduced into the casting box 100 from an input device 60, in particular a faucet, at the back of the casting box 100 (see arrow 11 at the first wall 12), which "pushes" this incoming slurry 2 at the bottom (see arrow 13) of the casting box 100, where it comes into contact with the steel belt 20.

Figure 4:
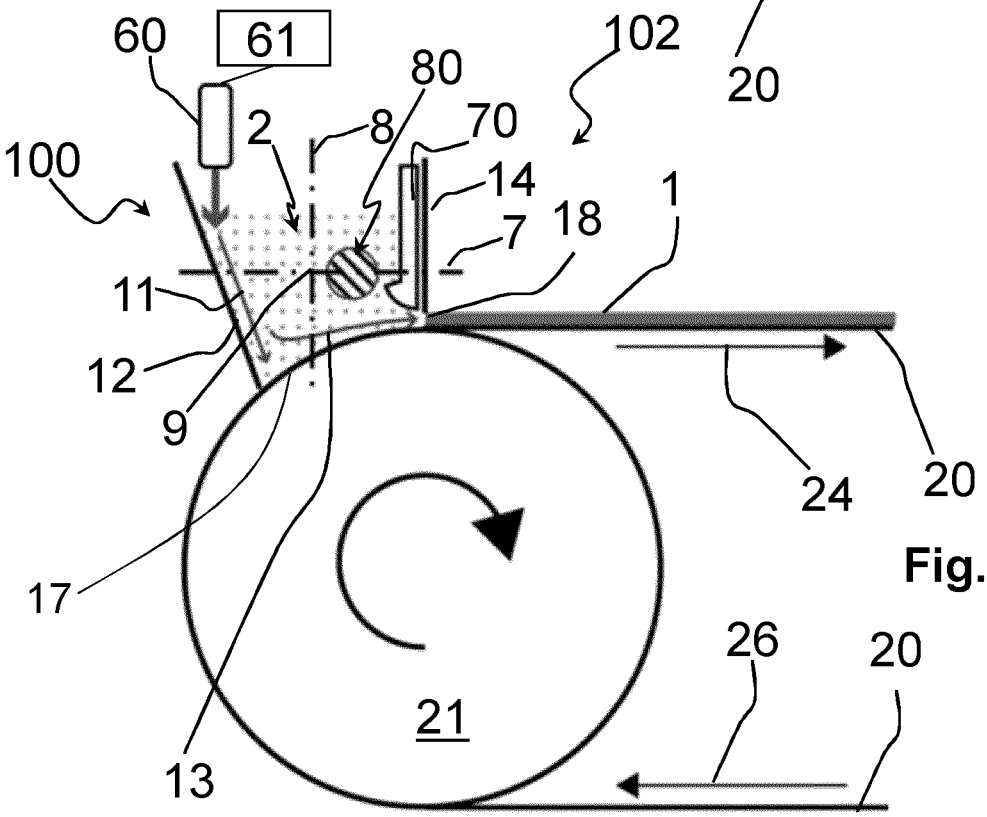
FIG. 4 is a schematic sectional view of a second embodiment of a casting apparatus for the production of a cast web of a material containing alkaloids according to the invention.

Slurry 2 from buffer tanks (not shown in the drawings) is transferred into the casting box 100 usually by means of a pump (schematically depicted with 61 in the FIGS. 3 and 4). Preferably, the pump comprises a control (not visible in the drawing) of flow rate to control the amount of slurry 2 introduced in the casting box 100. The pump 61 is advantageously designed to ensure that slurry transfer times are kept to the minimum necessary. The pump is fluidly connected, for example by means of a tube (not shown in the drawings), to the input device 60 to feed the casting box 10 with the slurry 2.

The amount of slurry 2 in the casting box 100 has a pre-determined level, which is preferably kept substantially constant so that the pressure exerted by the column of slurry 2 remains substantially the same. In order to keep the amount of slurry 2 substantially at the same level, the pump 61 controls the flow of slurry 2 to the casting box 100.

The input device 60 preferably acts as a distributor and distributes the slurry within the casting box 10.

The movement of the steel belt 20 forwards the slurry 2 towards the casting blade 70 at the front exit 18 of the casting box 10 (at the second wall 14). The casting blade 70 casts a part of the slurry 2 on the steel belt 20, while the remaining majority of the slurry 2 is not casted and recirculates inside the casting box 100.

The casting blade 70 is associated to the casting box 100 in order to cast the slurry. The casting blade 70 has a dominant dimension which is its longitudinal width. The casting blade 70 is for example substantially rectangular.

The casting blade 70 is attached to the casting box 100 preferably by means of an adjustable board (not shown in figures) which allows a precise control of the position of the casting blade 70.

Between the casting blade 70 and the steel belt 20 a gap is present, the dimensions of which determine—among others—the thickness of the cast web of homogenized tobacco material.

The casting apparatus 101 comprises also a bar-like element 80.

The bar-like element 80 is located inside the casting box 100 in contact with the slurry 2.

The bar-like element 80 is positioned at a first and at a second distance from the first and the second opposite walls 12 and 14, respectively, so that the slurry 2 can flow therethrough.

The bar-like element 80 is located in the central core volume where the slurry rotational speed would be very low or null in a casting box 100 according to the comparative embodiment, that is, without the bar-like element (see FIG. 2). The central core volume corresponds to the volume at and around the central "dead zone" 16 of FIG. 2. In other words, the bar-like element is a solid element that occupies the dead zone 16 of the casting box 10 of FIG. 2.

In the non-limiting example of FIG. 3, the bar-like element 80 is a substantially cylindrical shaft defining a longitudinal rotational axis and having a constant volume along the longitudinal axis. Preferably, the shaft has a smooth outer surface.

Preferably, a dimension of the bar-like element 80 in a cross section along a plane parallel to the casting direction 24 and preferably also vertical is comprised between about 10 millimeters and about 70 millimeters. More preferably, such a dimension is comprised between about 25 millimeters and about 45 millimeters.

Preferably, the longitudinal axis of the bar-like element 80 and the dominant dimension of the casting blade 70 are substantially parallel. Consequently, the bar-like element 80 is positioned substantially perpendicular to the casting direction 24.

The bar-like element 80 can have fixed attachments (not shown) to the third and fourth wall of the casting box 100 and—in this case—it is preferably flexible, so as the exact position of the bar-like element 80 in the area of the casting box with the lowest rotational speed of the slurry 2 can be automatically adjusted by the slurry movements themselves.

Instead, if the bar-like element 80 is rigid, the bar-like element 80 has freely moving attachments to the third and fourth wall of the casting box 100. These freely moving attachments (not shown) keep the bar-like element 80 transversal and in the overall center of the casting box 100, so as the exact position of the bar-like element 80 in the area of the casting box with the lowest rotational speed of the slurry 2 will be automatically adjusted by the slurry movements themselves.

The above-mentioned fixed attachments and freely moving attachments are provided at the opposite ends of the bar-like element 80.

A position variator (also not shown) can be provided between the opposite ends of the bar-like element 80 and the respective third and fourth wall of the casting box 100, adapted to change the position of the connection of the bar-like element end to the third or fourth wall, in order to choose the position of the bar-like element 80 which creates the weakest resistance to the slurry movements, depending on the type of slurry in the casting box 100.

The bar-like element 80 can be static, freely rotatable or motorized in rotation in respect of its longitudinal axis of rotation, which coincides with the central longitudinal axis of the the bar-like element 80.

In particular, in the case wherein the bar-like element 80 is freely rotatable in respect of the longitudinal axis of rotation, the bar-like element 80 can be divided in sectors (not visible in the drawings), each sector being independently rotatable.

In the case wherein the bar-like element 80 is motorized in rotation in respect of the longitudinal axis of rotation, the casting apparatus 101 includes a motor (not visible in the drawings) to rotate the bar-like element 80.

As shown in FIG. 3, the casting box 100 has a given casting box height, and the bar-like element 80 is positioned in the casting box 100 at a height which is substantially half of the casting box height.

The slurry 2 is supplied at the input device 60, which is positioned at a rear or upstream side of casting box 100 (near the first wall 12 of the casting box 100) and the casting blade 70 is located at a front or downstream side of the casting box 100 (near the second wall 14 of the casting box 100). Along the casting direction 24, the bar-like element 80 is substantially positioned at the middle of casting box 100, between the first and the second wall 12, 14.

With reference to FIG. 4, a second embodiment of a casting apparatus for the production of a cast web of a material containing alkaloids according to the present invention is represented and indicated with reference number 102.

The casting apparatus 102 of FIG. 4 differentiates from the casting apparatus 101 of FIG. 3 in that the bar-like element 80 has a different position inside the casting box 100. All the remaining components and parts of the casting apparatus 102 of FIG. 4 are the same of those of the casting apparatus 101 of FIG. 3. The same reference numbers are used for the corresponding components and parts of the invention of FIGS. 3 and 4, and the relative description is not repeated for the sake of conciseness.

As the bar-like element 80 of FIG. 3, the bar-like element 80 of FIG. 4 is positioned in the casting box 100 at a height which is substantially half of the casting box height.

Along the casting direction 24, the bar-like element 80 of FIG. 4 is substantially positioned in the half of casting box 100 close to the casting blade 70. Preferably, the bar-like element is horizontally located closer to the second wall 14 than to the first wall 12 of the casting box 100.

In FIG. 4 two crossed dashed lines 7, 8 are indicated. The two dashed lines 7, 8 are horizontal and vertical, respectively, and crosses at point 9. The horizontal dashed line 7 is positioned in the casting box 100 at a height which is substantially half of the casting box height. The vertical dashed line 8 is substantially positioned at the middle of casting box 100, that is the distance between line 8 and first wall 12 is the same as the distance between line 8 and wall 14. The point 9 corresponds to the position of the axis of the bar-like element 80 in the embodiment of FIG. 3. Differently, the axis of the bar-like element 80 in the embodiment of FIG. 4 is positioned on the horizontal dashed line 7 and between the vertical dashed line 8 and the second wall 14.

With reference to FIGS. 5-8, further four embodiments of bar-like elements to be positioned in casting apparatuses 101 and 102 according to the invention are represented and indicated with reference number 180, 280, 380, 480.

In the embodiments of FIGS. 3 and 4, the bar-like element 80 is a substantially cylindrical shaft. Preferably, the shaft has a smooth outer surface.

According to the embodiments of FIGS. 5-8, the bar-like elements 180, 280, 380, 480 have respective outer surfaces 182, 282, 382, 482, each of these outer surfaces 182, 282, 382, 482 including fins and/or grooves and/or textures. The outer surfaces 182, 282, 382, 482 have substantially cylindrical shape.

Figure 5:
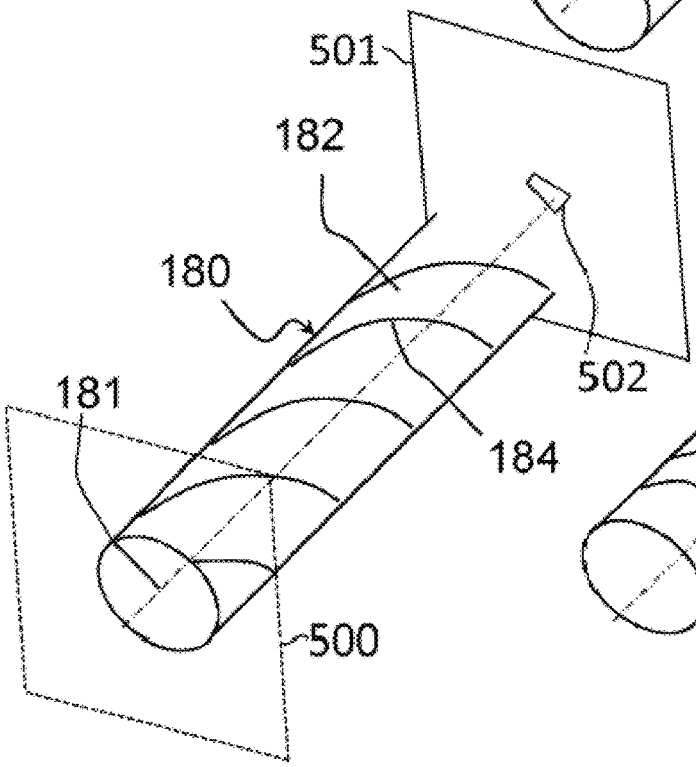

The bar-like element 180 of FIG. 5 includes a continuous helicoidal fin 184 protruding from the outer surface 182. The continuous helicoidal fin 184 has axis coinciding with the longitudinal axis 181 of the bar-like element 180. The bar like element 180 is connected to a third wall 500 with its first end and to a fourth wall 501 via a position variator 502 with its second end.

Figure 6:
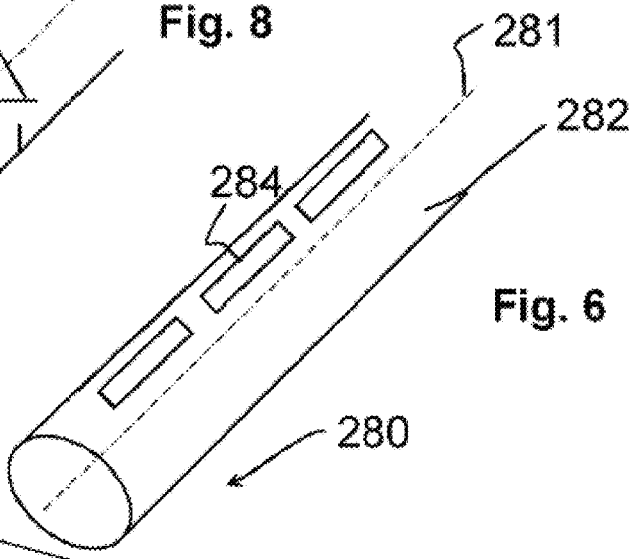

The bar-like element 280 of FIG. 6 includes a plurality of grooves 284 formed in the outer surface 282. The grooves 284 are substantially aligned, parallel to the longitudinal axis 281 of the bar-like element 280.

Figure 7:
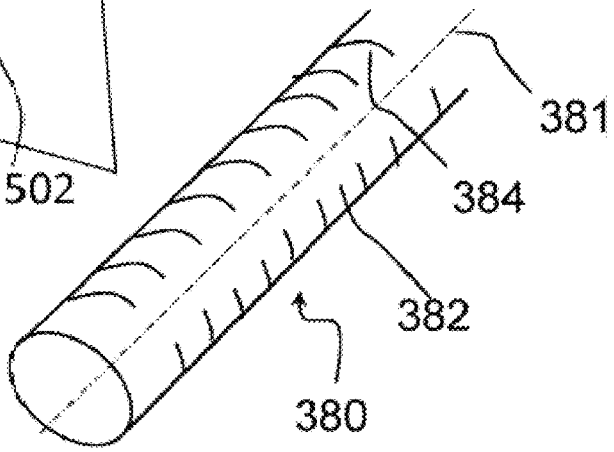

The bar-like element 380 of FIG. 7 includes a plurality of fins 384 protruding from the outer surface 382. The fins 384 are staggered and have substantially the same inclination with respect to the longitudinal axis 381 of the bar-like element 380.

Figure 8:
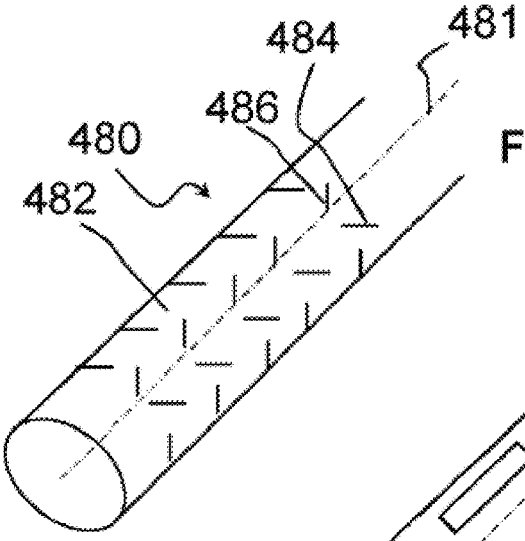
FIGS. 5-8 are perspective views of a component (bar-like element) of further four embodiments of a casting apparatus for the production of a cast web of a material containing alkaloids according to the invention.

The bar-like element 480 of FIG. 8 includes a plurality of fins 484, 486 protruding from the outer surface 482. The fins 484, 486 are staggered and have substantially two respective different inclinations with respect to the longitudinal axis 481 of the bar-like element 480.

According to other embodiments (not depicted), the bar-like element 80 of FIGS. 3 and 4 can have motorized fins and/or agitators on its substantially cylindrical outer surface. According to such embodiments, the shapes of fins or agitators are chosen so that their energy is converted into movement of the slurry 2 or into shear stress. Increasing the movement of the slurry 2 will even more prevent low speed areas, while generating shear stress (for instance by using dispersion blade agitators) in the slurry 2 would help to suppress possible clusters of slurry 2.

The functioning of the casting apparatus 101 or 102 is as follows. A slurry 2, formed preferably mixing and combining tobacco powder and other ingredients, is transferred from a buffer tank (not shown) to the casting apparatus 101 inside the casting box 100.

Inside the casting box 100, no "dead zone" where the speed of the slurry is very slow is present, due to the presence of any of the bar-like element 80-180-280-380-480. In substantially any volume of the casting box occupied by the slurry, the latter is moving at a speed different from zero. The step of casting of the slurry 2 into a web 1 of homogenous and uniform film thickness is performed on the movable support 20, for example the stainless steel belt. The casting step includes transferring the slurry 2 from the mixing tank to the casting box 100. Further, it preferably includes monitoring the level of slurry in the casting box 100, the moisture of the slurry inside the casting box 100, and the density of the slurry 2, by means of suitable sensors.

The thickness of the web 1 of homogenized tobacco material and grammage controlled by nucleonic gauge immediately after casting are preferably monitored and feedback-controlled using slurry measuring device. The casting is performed by means of casting blade 70 forming a gap with the movable support 20, gap that can also be feedback controlled.

Further, the casting apparatus 101, 102 may be part of a bigger apparatus for the production of cast sheet. In this apparatus (not depicted) the cast web 1 undergoes a drying step by means of a drying apparatus. The drying apparatus includes a plurality of individual drying zones. Each drying zone preferably includes steam heating on the bottom side of the support and heated air above the movable support 20 and preferably also adjustable exhaust air control. Within the drying apparatus, the homogenized tobacco web 1 is dried to desired final moisture on the support 20.

The drying step includes preferably a uniform and gentle drying of the cast web 1 in an endless, stainless steel belt dryer with individually controllable zones. During the drying, a monitoring step of the cast web 1 temperature at each drying zone to ensure a gentle drying profile at each drying zone is preferably performed. The cast web 1 is dried to desired final moisture on the steel belt 20 with steam pan heating from bottom and top air drying. Every drying zone is equipped with steam flow and pressure control and air temperature and air flow are fully adjustable to provide the desired drying profile and ensuring product residence time is respected.

Preferably, at the end of the casting step and of the drying step, the homogenized tobacco web is removed from the support 20. Doctoring of the cast web 1 after the drying station at the right moisture content is preferably performed. The cast web goes preferably through a secondary drying process to remove further moisture content of the web 1 to reach moisture target or specification. Preferably, in this second drying step, the cast web 1 is laid onto a wire, such that moisture can be easily removed from both surfaces of the web 1. After the drying step, the cast web 1 is preferably wound in one or more bobbins in a winding step, for example to form a single master bobbin. This master bobbin may be then used to perform the production of smaller bobbins by slitting and small bobbin forming process. The smaller bobbin may then be used for the production of an aerosol-generating article (not shown).

The invention claimed is:

1. Casting apparatus for the production of a cast web of a material containing alkaloids, the casting apparatus comprising:

a casting box having casting box walls including a first and a second opposite walls, and adapted to contain a slurry;

a movable support;

a casting blade adapted to cast the slurry contained in the casting box onto the movable support so as to form the cast web of said material containing alkaloids; and a bar-like element located inside the casting box and configured to be completely submerged in the slurry, the bar-like element being positioned at a first and at a second distance from the first and the second opposite walls, respectively, so that the slurry can flow around the bar-like element, wherein the movable support is adapted to move along a casting direction and wherein the bar-like element is positioned perpendicular to the casting direction, wherein the casting box has a given casting box height, and the bar-like element is positioned in the casting box at a height which is half of the casting box height.

2. The casting apparatus according to claim 1, wherein the bar-like element is rotatable around an axis.

3. The casting apparatus according to claim 2, wherein the bar-like element is freely rotatable.

4. The casting apparatus according to claim 2, including a motor to rotate the bar-like element.

5. The casting apparatus according to claim 2, wherein the bar-like element is divided in sectors, each sector being independently rotatable.

6. The casting apparatus according to claim 1, wherein the bar-like element has an outer surface and it includes a plurality of fins protruding from the outer surface.

7. The casting apparatus according to claim 1, wherein a distance between the bar-like element and the casting blade is constant along a dominant dimension of the bar-like element.

8. The casting apparatus according to claim 1, wherein an axis of the bar-like element and a dominant dimension of the casting blade are parallel.

9. The casting apparatus according to claim 1, including a vibrator device connected to the bar-like element, adapted to vibrate the bar-like element.

10. The casting apparatus according to claim 1, wherein the movable support is adapted to move along a casting direction and wherein a dimension of the bar-like element in a cross section parallel to the casting direction is comprised between about 10 millimeters and about 70 millimeters.

11. The casting apparatus according to claim 1, wherein the bar-like element includes a coating.

12. The casting apparatus according to claim 1, wherein the casting box includes a third and a fourth opposite walls, and wherein the bar-like element includes a first and a second end, said first and second end being connected to the third and fourth wall, and further including a position variator adapted to change the position of a connection of the first or second end to the third or fourth wall.

* * * * *